US005205718A

United States Patent [19]

Fujisawa et al.

[11] Patent Number: 5,205,718

[45] Date of Patent: Apr. 27, 1993

[54] VARIABLE DISPLACEMENT SWASH PLATE TYPE COMPRESSOR

[75] Inventors: Yoshihiro Fujisawa; Hiroaki Kayukawa; Kazuya Kimura; Chuichi Kawamura; Hideki Mizutani, all of Kariya, Japan

[73] Assignee: Kabushiki Kaisha Toyoda Jidoshokki Seisakusho, Kariya, Japan

[21] Appl. No.: 942,714

[22] Filed: Sep. 9, 1992

[30] Foreign Application Priority Data

Sep. 18, 1991 [JP] Japan ..... 3-238402
Apr. 28, 1992 [JP] Japan ..... 4-110531

[51] Int. Cl.[5] ..... F04B 1/28
[52] U.S. Cl. ..... 417/222.2
[58] Field of Search ..... 417/222.2

[56] References Cited

U.S. PATENT DOCUMENTS 4,702,677 10/1987 Takenaka et al. ..... 417/270
4,723,891 2/1988 Takenaka et al. ..... 417/222.2
4,732,544 3/1988 Kurosawa ..... 417/222.2
5,145,326 9/1992 Kimura et al. ..... 417/222.2

*Primary Examiner*—Leonard E. Smith
*Attorney, Agent, or Firm*—Brooks Haidt Haffner & Delahunty

[57] ABSTRACT

A variable displacement swash plate type compressor comprises a suction chamber, a discharge chamber and a crank chamber. A flow rate control valve mechanism is provided along a refrigerant supply passage, which connects the discharge chamber to the crank chamber. The flow rate control valve mechanism is provided with a discharge pressure chamber and an intermediate chamber. A valve hole is provided between the discharge pressure chamber and the intermediate chamber, to permit both chambers to communicate with each other. A pressure sensitive member is provided in the intermediate chamber to separate the intermediate chamber into a first and a second pressure sensitive chambers. The first pressure sensitive chamber communicates with the discharge pressure chamber via the valve hole. The second pressure sensitive chamber communicates with either the crank chamber or the suction chamber. The pressure sensitive member is displaceable as a function of the pressure difference between the first and second pressure sensitive chambers. A restriction permits the first pressure sensitive chamber and the crank chamber to communicate with each other. A valve body is coupled to the pressure sensitive member to be displaceable in synchrony with the action of the pressure sensitive member, and regulates the opening of the valve hole according to the displacement. A return member biases the valve body and the pressure sensitive member to a valve open position when the pressure in the discharge chamber becomes almost zero.

10 Claims, 9 Drawing Sheets

VARIABLE DISPLACEMENT SWASH PLATE TYPE COMPRESSOR

BACKGROUND OF THE INVENTION

This application claims the priority of Japanese Patent Applications Nos. 3-238402 filed Sep. 18, 1991 and 4-110531 filed Apr. 28, 1992, which are incorporated herein by reference.

FIELD OF THE INVENTION

The present invention relates to variable displacement swash plate type compressors for use in vehicles and refrigerating systems. More particularly, this invention relates to a compressor which controls the crank chamber pressure. A volume control valve changes the inclination of the swash plate, in relation to the difference between the pressures in the compression chamber and the crank chamber, thereby controlling the discharge volume.

DESCRIPTION OF THE RELATED ART

In conventional compressors of this type, as disclosed in, for example, Japanese Unexamined Patent Publication Nos. 60-175783 and 63-16177, a blow-by gas leaks from a compression chamber into a crank chamber through a side clearance between the outer surface of a piston and the inner wall of a cylinder bore during the compression process. The gas pressure in the crank chamber is controlled by properly discharging the blow-by gas to a suction chamber with the volume control valve mechanism. By regulating the gas pressure, it would be possible to variably control the inclination of the swash plate or the discharge volume of the compressor.

The above-mentioned supply of the blow-by gas from the compression chamber into the crank chamber is not stable, particularly when the discharge pressure is low. The blow-by gas alone provides insufficient amount of refrigerant supply to the crank chamber. It is therefore not possible to promptly control the inclination of the swash plate, which may interfere with the proper variable control of the discharge volume. In an attempt to resolve this shortcoming, it has been proposed to provide a refrigerant supply passage that connects the discharge chamber of the compressor and the crank chamber, and provides a restriction on that passage to supply discharged gas according to the restricted amount into the crank chamber, thereby compensating for the insufficient amount of refrigerant supply by the blow-by gas.

However, when the refrigerant supply passage with the restriction is provided, as shown in FIG. 11, the amount of refrigerant supply through the refrigerant supply passage (indicated by a curve E3), and the amount of refrigerant supply by the blow-by gas (indicated by a curve E4) increase with an increase in the discharge pressure Pd. When the discharge pressure Pd is particularly high, the sum of both amounts of refrigerant supply (indicated by the curve E3+4) becomes considerably large.

Such a variable displacement swash plate type compressor is often used as a refrigerant gas compressor that forms a refrigerating circuit system in a refrigerating apparatus. When the discharge pressure Pd is high, the discharge gas, which exceeds the required level, is returned from the discharge chamber to the suction chamber through the restriction disposed in the refrigerant supply passage, the crank chamber and the volume control valve mechanism. As a result, the ratio of the refrigerant gas to be supplied to the refrigerating circuit system of the refrigerating apparatus from the discharge chamber drops. This raises a new problem, that is a lower refrigerating performance.

SUMMARY OF THE INVENTION

It is therefore an object of the present invention to provide a variable displacement swash plate type compressor which can smoothly effect variable control of the discharge volume, and efficiently supply the compressed gas without being affected by a change in the discharge pressure of the compressor.

To achieve the above object, the variable displacement swash plate type compressor embodying the present invention comprises a suction chamber and a discharge chamber for a refrigerant gas, a plurality of pistons reciprocate in respective cylinder bores, and a swash plate is disposed in a crank chamber. The pistons are drivably coupled to the swash plate. As each piston reciprocates, the refrigerant gas is sucked from the suction chamber and compressed in the associated cylinder bore.

The refrigerant gas is then discharged into the discharge chamber. The inclination of the swash plate is changed as a function of the difference between the pressure in the compression chamber within the cylinder bore, and the pressure in the crank chamber, for variably controlling the discharge volume of the refrigerant gas.

A flow rate control valve mechanism is provided on a refrigerant supply passage, which connects the discharge chamber to the crank chamber. The flow rate control valve mechanism is provided with a discharge pressure chamber located on the discharge chamber side on the refrigerant supply passage. An intermediate chamber is located on the crank chamber side on the refrigerant supply passage. A valve hole is provided between the discharge pressure chamber and the intermediate chamber to permit both chambers to communicate with each other.

A pressure sensitive member is provided in the intermediate chamber to separate the intermediate chamber into first and second pressure sensitive chambers. The first pressure sensitive chamber communicates with the discharge pressure chamber via the valve hole. The second pressure sensitive chamber communicates with the crank chamber or the suction chamber.

The pressure sensitive member is displaceable as a function of the difference between the pressures in the first and second pressure sensitive chambers. A restriction permits the first pressure sensitive chamber and the crank chamber to communicate with each other. A valve body is coupled to the pressure sensitive member, and is displaceable in synchrony with the action of the pressure sensitive member. It changes the amount of opening of the valve hole according to the displacement. A return member returns the valve body and the pressure sensitive member to positions where the valve hole is opened by the valve body, when the pressure in the discharge chamber becomes almost zero.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of the present invention will now be described referring to FIGS. 1 through 5.

Figure 1:
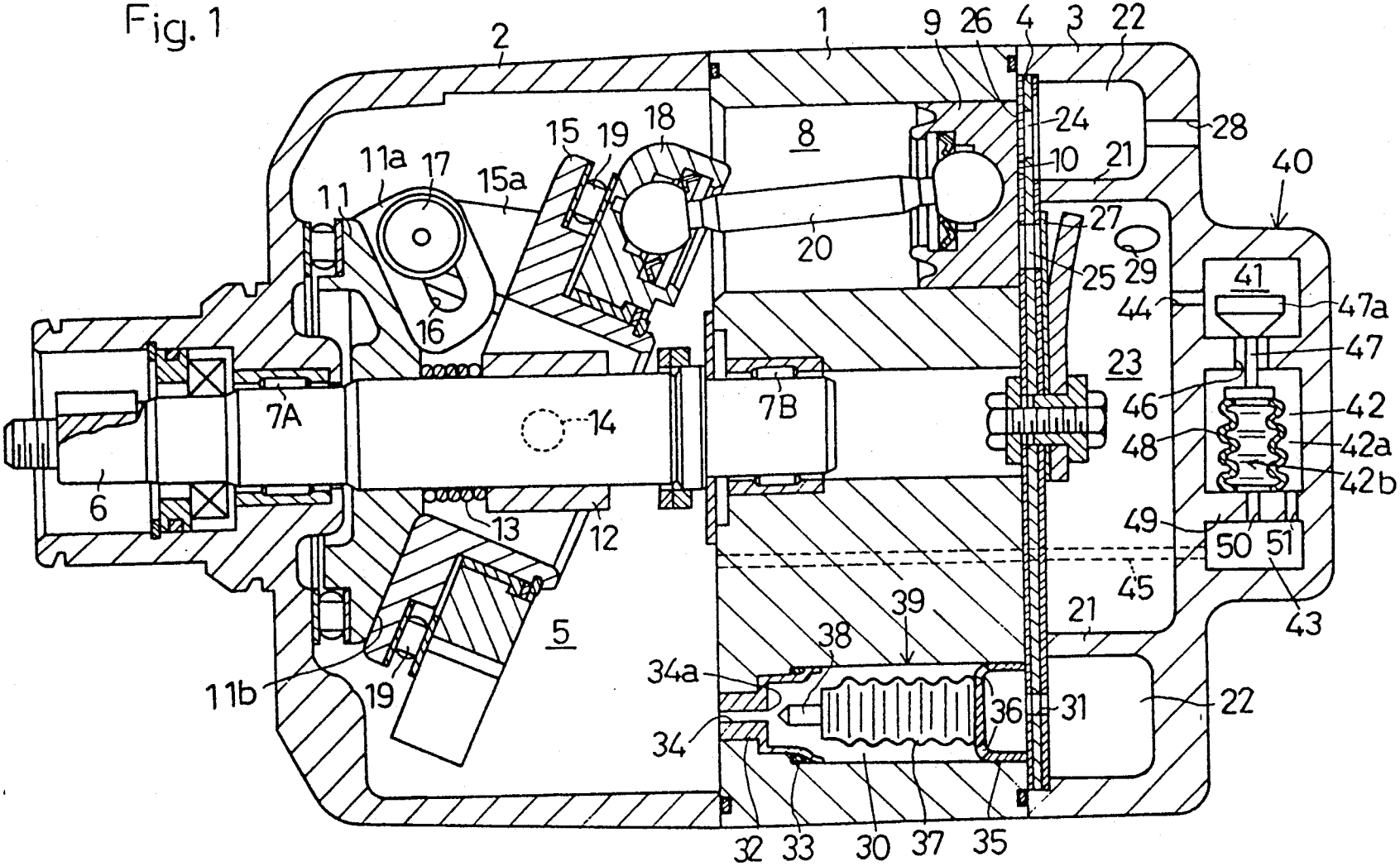
FIG. 1 is a side cross-sectional view of a variable displacement swash plate type compressor according to a first embodiment of the present invention.

As shown in FIG. 1, a front housing 2 is connected to one end of a cylinder block 1, while a rear housing 3 is connected via a valve plate 4 to the other end of the cylinder block 1. A drive shaft 6 is disposed in a crank chamber 5 in the front housing 2, and is supported, rotatably, by radial bearings 7A and 7B.

A plurality of cylinder bores 8 (only one shown) are formed in the cylinder block 1 around the radial bearing 7B. Each cylinder bore 8 communicates with the crank chamber 5. Pistons 9 are inserted into the respective cylinder bores 8 for defining a compression chamber 10 between each piston 9 and the valve plate 4.

A drive plate 11 is rotatable in synchrony with the drive shaft 6, and is supported by the drive shaft 6 in the crank chamber 5. A sleeve 12 is supported slidably on the drive shaft 6. A spring 13 is disposed between the drive plate 11 and the sleeve 12.

A rotary plate 15 is supported swingably on the sleeve 12 via a pair of pins 14. The rotary plate 15 is ring shaped, and surrounds the drive shaft 6, with a bracket 15*a* projecting from part of the rotary plate 15. A support arm 11*a* protrudes from the drive plate 11, with an elongated hole 16 formed therein. A guide pin 17 is attached to the distal end of the bracket 15*a*. In accordance with the engagement of the guide pin 17 with the elongated hole 16 of the support arm 11*a*, the rotary plate 15 rotates together with the drive shaft 6 and drive plate 11.

As the rotary plate 15 swings back and forth, the sleeve 12 slides back and forth on the drive shaft 6. The sliding of the sleeve 12 toward the radial bearing 7A is restricted when the spring 13 (shown in FIG. 1) is compressed most. An inclined contact surface 11*b* is formed on the drive plate 11, such that, when the rotary plate 15 abuts the contact surface 11*b*, and restricts the tilting of the rotary plate 15, the rotary plate 15 comes to the most tilted position.

A swash plate 18 is mounted on the rotary plate 15 via a thrust bearing 19. Like the rotary plate 15, the swash plate 18 is ring shaped, and surrounds the drive shaft 6. The swash plate 18 is functionally coupled to the individual pistons 9 via a plurality of connection rods 20. The swash plate 18 swings forward and backward interlockingly with the rotation of the drive shaft 6 and the rotation of the tilted rotary plate 15, while its rotation is inhibited by a rotation stop rod (not shown). In accordance with this swing action, each piston 9 reciprocates in its associated cylinder bore 8.

A suction chamber 22 and a discharge chamber 23 are separated by a partition 21, and are formed in the rear housing 3. The valve plate 4 is provided with a suction port 24 and a discharge port 25 in association with each cylinder bore 8. Each compression chamber 10 communicates with the suction chamber 22 and the discharge chamber 23, through the suction port 24 and discharge port 25. A suction valve 26 and a discharge valve 27 are respectively provided in each suction port 24 and each discharge port 25.

During the suction stage of the piston 9, the suction port 24 is opened by the suction valve 26, and the discharge port 25 is closed by the discharge valve 27. During the discharge stage of the piston 9, the suction port 24 is closed by the suction valve 26, and the discharge port 25 is opened by the discharge valve 27. The suction chamber 22 and discharge chamber 23 are provided with an inlet 28 and an outlet 29, respectively, through which the compressor of this embodiment is connected, for example, to a refrigerating circuit (not shown) of a refrigerating apparatus.

As shown in FIG. 1, the cylinder block 1 is provided with a housing 30, and the valve plate 4 is provided with a communication hole 31 for allowing the housing 30 to communicate with the suction chamber 22. A coupling 32 is fitted, via a seal ring 33, in the wall of the housing 30, on the side of the crank chamber 5. A through hole 34 is bored in the coupling 32 to permit the housing 30 to communicate with the crank chamber 5. A base 35 is fixed to the inner wall of the housing 30 on the side of the valve plate 4, with a plurality of through holes 36 bored in the base 35.

A bellows 37 is secured on the base 35. Gas with predetermined pressure is sealed in this bellows 37, so that the bellows 37 expands and contracts as a function of the pressure difference in the bellows 37 and that in the housing 30. A needle valve 38 is mounted on the distal end of the bellows 37, so as to be engaged with, or disengaged from a valve seat 34*a* of the through hole 34, in accordance with the movement of the bellows 37. As the needle valve 38 is engaged with, or disengaged from the valve seat 34*a*, the crank chamber 5 communicates with the suction chamber 22 through the through hole 34, housing 30, through hole 36 and communication hole 31, or is shut off from the chamber 22, for controlling the pressure in the crank chamber 5. As is apparent from the foregoing description, the coupling 32, bellows 37, and needle valve 38 form a volume control valve mechanism 39.

Figure 2:
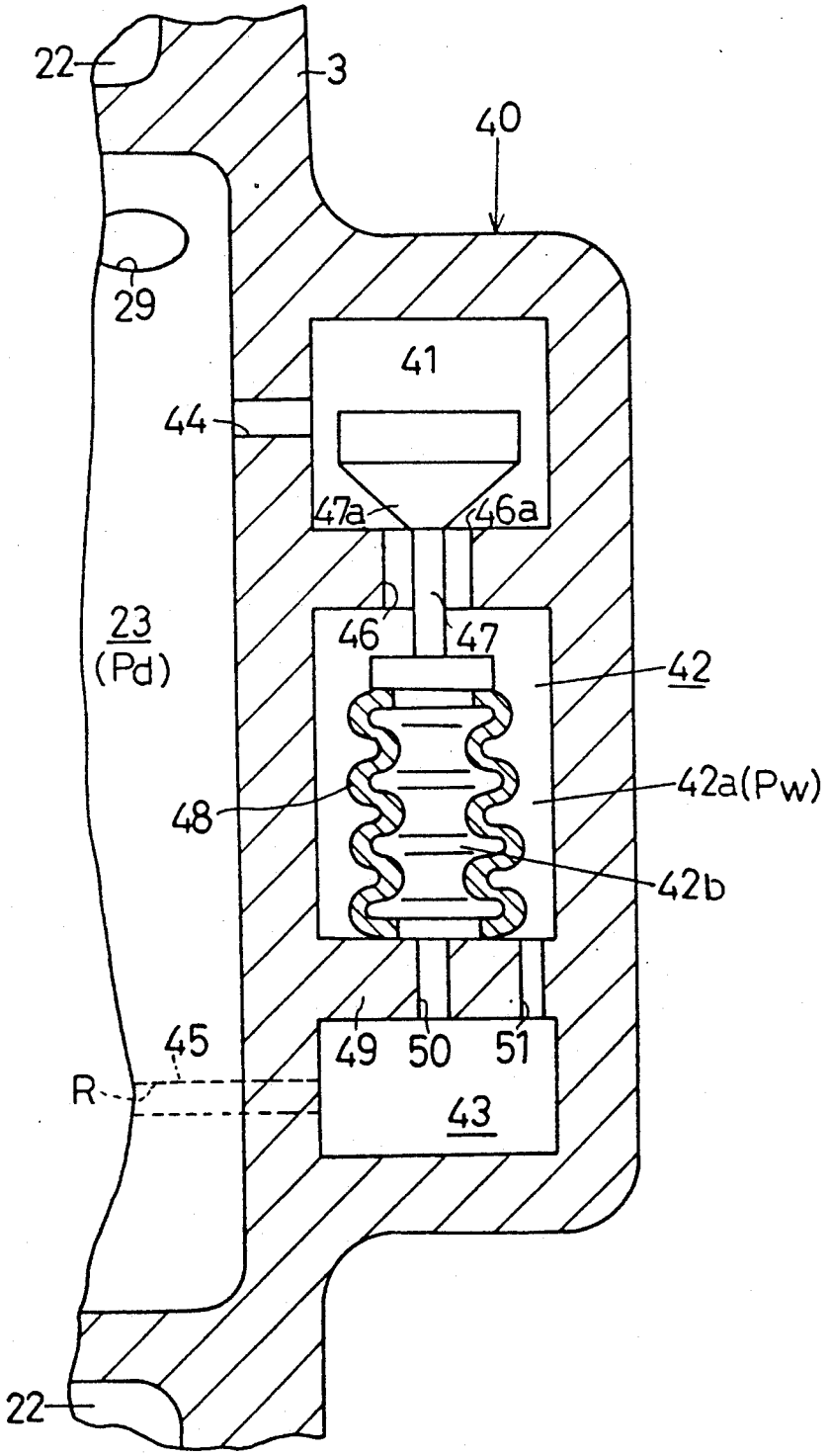
FIG. 2 is an enlarged cross-sectional view of a flow rate control valve mechanism for use in the compressor in FIG. 1.

As illustrated in FIGS. 1 and 2, a flow rate control valve mechanism 40 is provided in the side wall of the rear housing 3. The flow rate control valve mechanism 40 is provided with a discharge pressure chamber 41, an intermediate chamber 42 and a crank-chamber pressure chamber (hereinafter simply referred to as crank pressure chamber) 43. The discharge pressure chamber 41 communicates with the discharge chamber 23 via a communication opening 44. The crank pressure chamber 43 communicates with the crank chamber 5 via a passage 45, which extends through the rear housing 3 and the cylinder block 1.

A valve opening 46 is provided to allow the discharge pressure chamber 41 to communicate with the intermediate chamber 42. A valve body 47 is loosely fitted in the valve hole 46 such that it is movable in the upward and downward directions. The valve body 47 has a head 47*a* retained in the discharge pressure chamber 41. The head 47*a* is engaged with, or disengaged from a valve seat 46*a* at the upper periphery of the valve hole 46. In accordance with this engagement or disengagement, the discharge pressure chamber 41 communicates with the intermediate chamber 42 or is fluidly disconnected from the chamber 42.

An elastic bellows 48 is retained in the intermediate chamber 42, and serves as a pressure sensitive member and a return member. The bellows 48 has its bottom end secured to a partition 49 between the intermediate chamber 42 and the crank pressure chamber 43. The upper end of the bellows 48 is connected to the bottom end of the valve body 47, and is covered by the valve body 47. The bellows 48 separates the intermediate chamber 42 into an outer chamber 42*a* (first pressure sensitive chamber) which communicates with the discharge pressure chamber 41, and an inner chamber 42*b* (second pressure sensitive chamber) which communicates with the crank chamber 5. When the compressor is stopped, and the discharge pressure is zero, the valve body 47 is held at a position which maximizes the opening of the valve 46, as shown in FIG. 2, under the elastic force of the bellows 48.

A through hole 50 and a restriction 51 are formed through the partition 49. The through hole 50 permits the inner chamber 42*b* to communicate with the crank pressure chamber 43, while the restriction 51 allows the outer chamber 42*a* to communicate with the crank pressure chamber 43. The through hole 50 therefore causes the refrigerant gas in the crank chamber 5 to enter the inner chamber 42*b*. The restriction 51 controls the flow rate of the compressed refrigerant gas flowing into the outer chamber 42*a* when the refrigerant gas is supplied via the crank pressure chamber 43 and passage 45, to the crank chamber 5.

According to the first embodiment, the through hole 44, the discharge pressure chamber 41, the valve hole 46, the inner chamber 42*a*, the restriction 51, the crank pressure chamber 43 and the passage 45 constitute a refrigerant supply passage R which runs from the discharge chamber 23 to the crank chamber 5.

Figure 3:
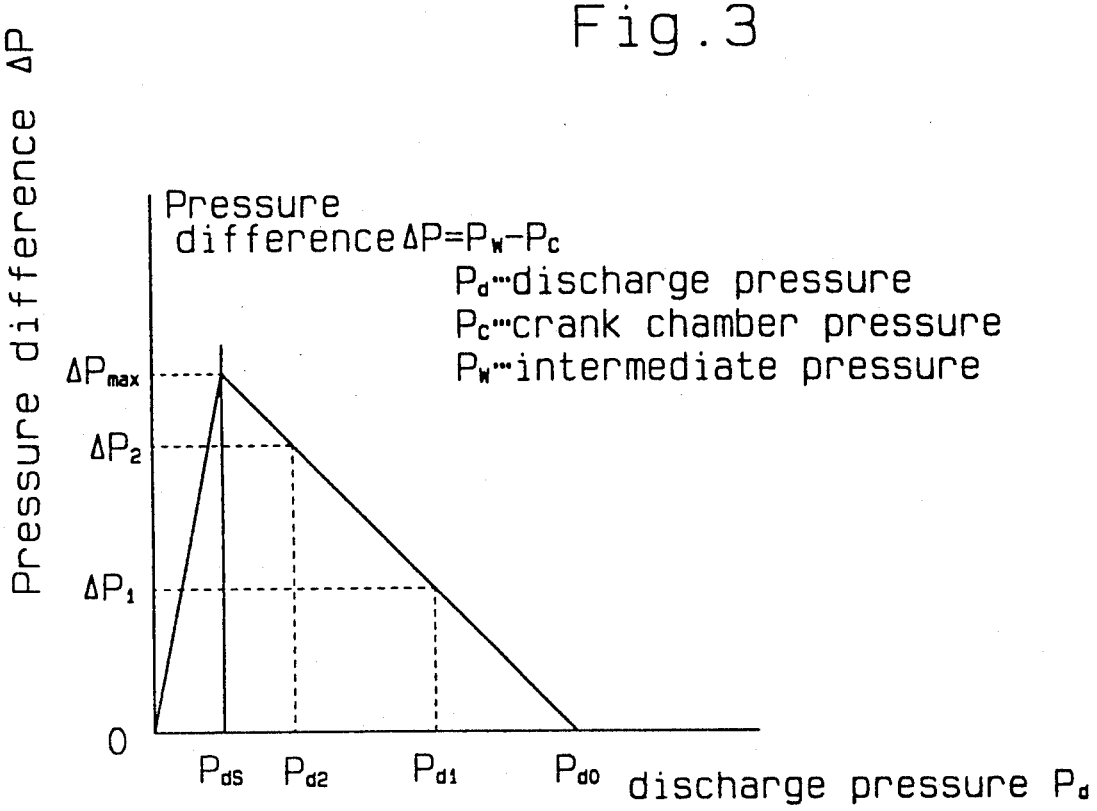
FIG. 3 is a graph illustrating the relationship between the discharge pressure of the compressor in FIG. 1 and the pressure difference in inner and outer chambers of a bellows used in the flow rate control valve mechanism of FIG. 2.
Figure 4:
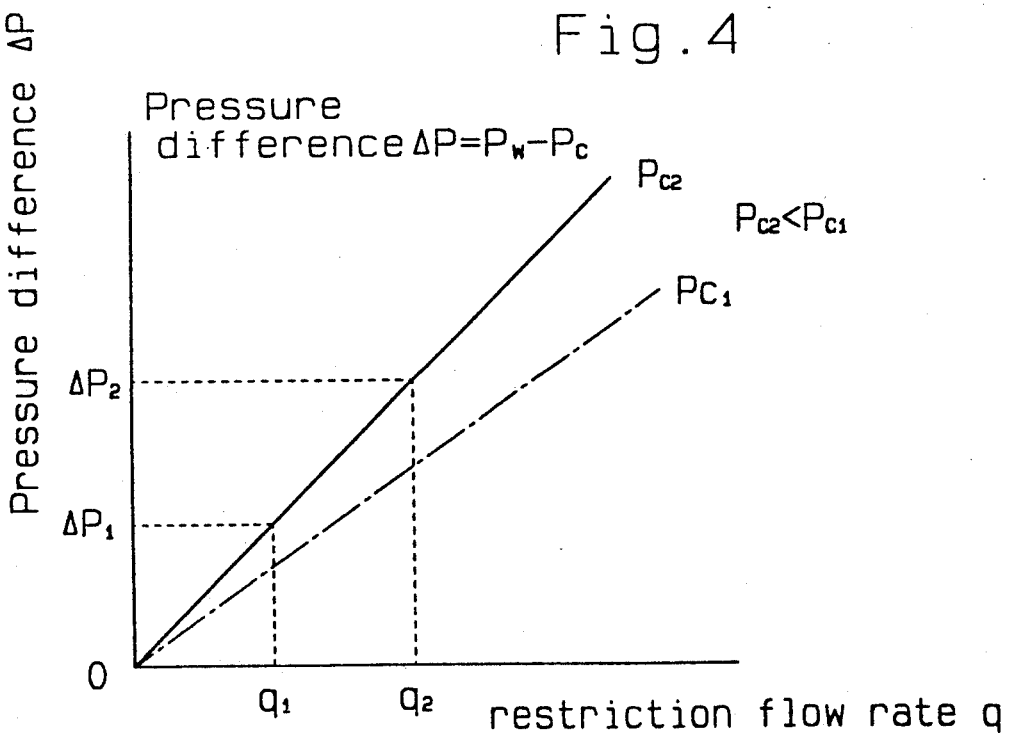
FIG. 4 is a graph showing the relationship between the flow rate at a restriction of the compressor in FIG. 1 and the pressure difference in the inner and outer chambers of the bellows of FIG. 3.
Figure 5:
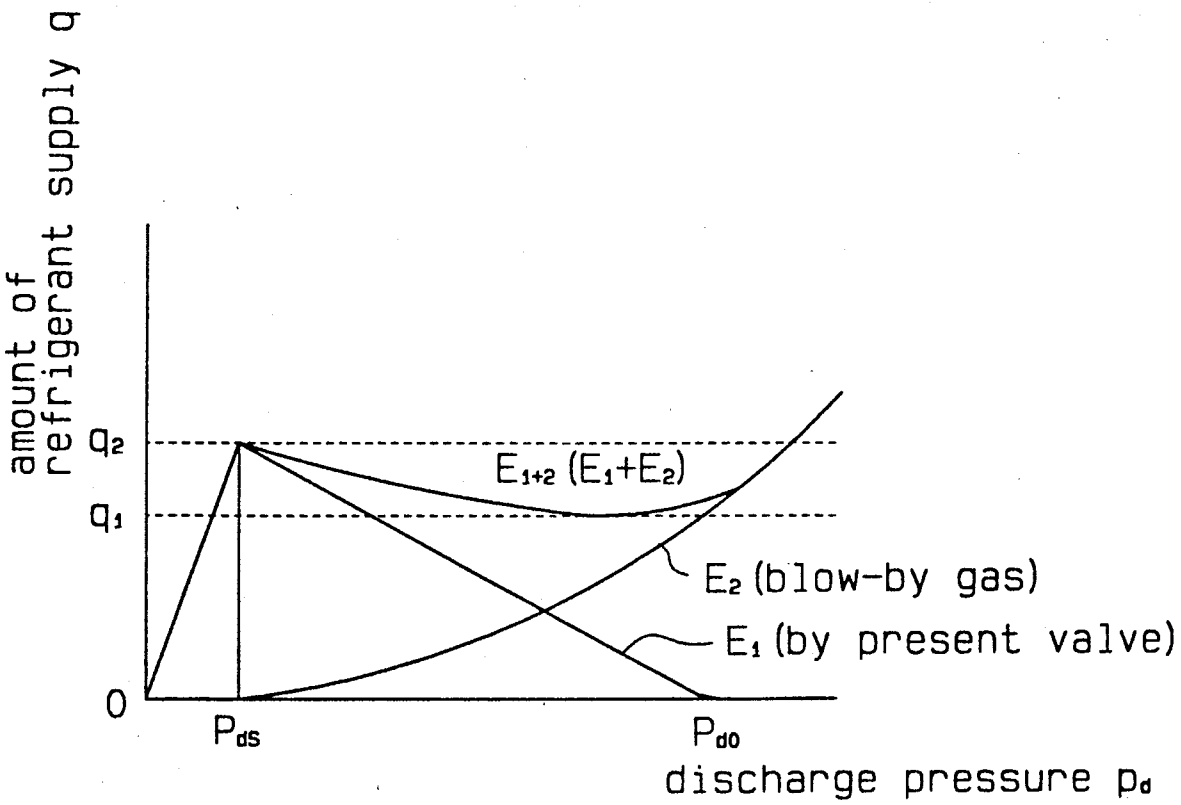
FIG. 5 is a graph illustrating the relationship between the discharge pressure of the compressor in FIG. 1 and the volume of refrigerant supplied to the crank chamber.

The flow rate control valve mechanism 40 of the first embodiment has characteristics as specified by graphs given in FIGS. 3 through 5. In the diagrams, Pd is the pressure in the discharge chamber 23 (discharge pressure), Ps is the pressure in the suction chamber 22 (suction pressure), Pc is the pressure in the crank chamber 5 (crank chamber pressure), and Pw is the pressure in the outer chamber 42*a* (intermediate pressure).

The difference between the intermediate pressure Pw and the crank chamber pressure Pc, $\Delta P$ ($\Delta P = Pw - Pc$), increases when the discharge pressure Pd is in a range from zero to predetermined discharge pressure Pds, and it is maximum when Pd becomes Pds, as shown in FIG. 3. This predetermined discharge pressure Pds is previously determined in such a way as to properly set the timing for the opening of the valve hole 46 to start becoming smaller by the action of the valve body 47, and depends on the elastic force of the bellows 48. In other words, the elastic force of the bellows 48 is determined to set the maximum difference $\Delta Pmax$ to the proper value. When the discharge pressure Pd is in a range from the predetermined discharge pressure Pds to critical discharge pressure Pd0 (the pressure at the time the valve hole 46 is closed), the difference $\Delta P$ linearly decreases with an increase in the discharge pressure Pd for the following reason. As the discharge pressure Pd increases, the intermediate pressure Pw increases. The increased intermediate pressure acts on the bellows 48 and the valve body 47 to reduce the opening of the valve hole 46. When the opening of the valve hole 46 becomes smaller, the amount of refrigerant supply to the outer chamber 42*a* from the discharge pressure chamber 41 decreases, thus reducing the amount of refrigerant discharge from the restriction 51. Therefore, when the discharge pressure Pd is stable, the opening of the valve hole 46 is controlled, to keep the pressure difference $\Delta P$ nearly constant, by means of the valve body 47, as a function of the difference between the intermediate pressure Pw and the crank chamber pressure Pc.

When the discharge pressure Pd becomes equal to, or greater than the critical discharge pressure Pd0, the valve body 47 abuts the valve seat 46*a* to completely block the valve hole 46. As a result, the difference $\Delta P$ between the intermediate pressure Pw and the crank chamber pressure Pc becomes zero.

As shown in FIG. 4, the flow rate q, of the refrigerant passing through the restriction 51, and the above pressure difference $\Delta P$, have such a proportional relation that as the pressure difference $\Delta P$ increases, the restriction flow rate q linearly increases. Given that $\Delta P1$ and $\Delta P2$ are the pressure differences corresponding to discharge pressures Pd1 and Pd2, and q1 and q2 are the restriction flow rates corresponding to Pd1 and Pd2 in FIGS. 3 and 4, the relation of $q1 < q2$ is established when $Pd2 < Pd1$. As long as the discharge pressure Pd is in the range from the predetermined discharge pressure Pds to the critical discharge pressure Pd0, the higher the discharge pressure Pd is, the smaller the restriction flow rate q or the volume of refrigerant supply to the crank chamber 5 becomes.

In other words, the volume of refrigerant supply to the crank chamber 5 via the flow rate control valve mechanism 40 increases in proportion to an increase in the discharge pressure Pd, when Pd ranges between zero and the predetermined discharge pressure Pds, as indicated by a curve E1 in FIG. 5. When the discharge pressure Pd lies in the range from the predetermined discharge pressure Pds to the critical discharge pressure Pd0, the volume of refrigerant supply linearly decreases; and when Pd is equal to or exceeds Pd0, the refrigerant supply to the crank chamber 5 is stopped. The volume of the blow-by gas leaking to the crank chamber 5 simply increases with an increase in the discharge pressure Pd, as indicated by a curve E2 in FIG. 5. As further indicated by a curve E1+2 in FIG. 5, the sum of the volume of refrigerant supply by the flow rate control valve mechanism 40 and the volume of refrigerant supply by the blow-by gas becomes stable between q1 and q2, while the discharge pressure Pd is in the range from the predetermined discharge pressure Pds to the critical discharge pressure Pd0.

The proportional inclination in the relation between the restriction flow rate q and the pressure difference ΔP is a function of the crank chamber pressure Pc. As indicated by the solid line and the broken line in FIG. 4, the greater the crank chamber pressure Pc is (expressed by Pc2<Pc1), the lower the proportional inclination becomes. When the crank chamber pressure Pc varies, even if the pressure difference ΔP is constant, the restriction flow rate q changes.

According to the first embodiment, as apparent from FIG. 5, the refrigerant gas is stably supplied to the crank chamber 5 within a given pressure range, regadless of a change in the discharge pressure Pd. Unlike conventional devices, even when a load in the refrigerating circuit is low and the discharge pressure Pd is low, there will be a sufficient volume of discharged gas supply to the crank chamber 5. It is thus possible to prevent the controllability of the discharge volume from dropping due to an insufficient volume of discharged gas. Even when the load in the refrigerating circuit is high and the discharge pressure Pd is high, there will not be an oversupply of discharged gas to the crank chamber 5. This can prevent the volume of discharged gas supply to the refrigerating circuit from relatively decreasing, which otherwise reduces the refrigerating performance.

According to the first embodiment, when the drive shaft 6 stops rotating to drop the discharge pressure Pd, the elastic force of the bellows 48 displaces the valve body 47 in a direction to maximize the opening of the valve hole 46 in FIG. 2 (i.e., upward). Consequently, the compressed gas in the discharge chamber 23 flows into the crank chamber 5 via the flow rate control valve mechanism 40, rapidly making the crank chamber pressure Pc greater than the suction pressure Ps (Ps<Pc). At this time, this pressure increase together with the action of the spring 13 cause the sleeve 12 to promptly slide rightward (FIG. 1) so as to approach the cylinder block 1, therefore setting the inclination of the swash plate 18 to the minimum angle. When this compressor is activated, the discharge volume becomes minimum. This minimizes the torque load of the drive shaft 6 so that the compressor can be activated smoothly.

Further, since the bellows 48 also serves as a pressure sensitive member and a return member in this embodiment, the number of necessary components can be reduced, for ensuring easier assembly.

A second embodiment of the present invention will now be described referring to FIG. 6.

Figure 6:
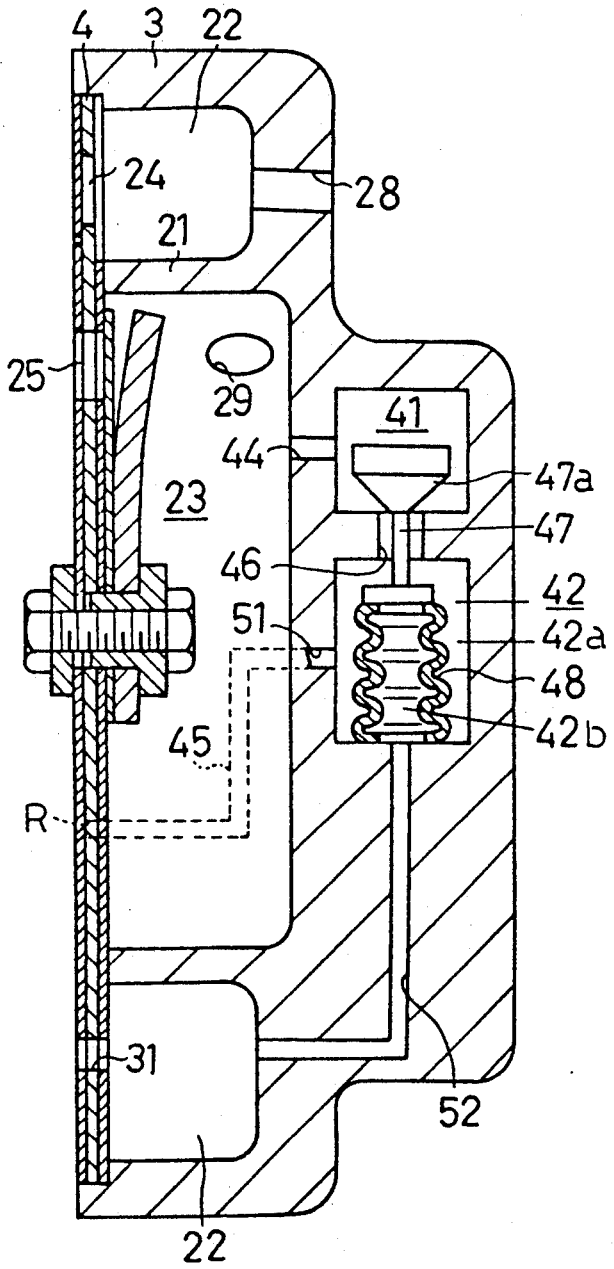
FIG. 6 is an enlarged cross-sectional view of a flow rate control valve mechanism for use in a compressor according to a second embodiment of the present invention.

In the second embodiment shown in FIG. 6, the inner chamber **42*b* communicates with the suction chamber 22 via a passage 52, to supply the refrigerant gas with suction pressure Ps into the inner chamber 42*b*. The compressor may be allowed to communicate with a suction pipe (not shown) of a refrigerating apparatus, via the passage 52. Likewise, the compressor may be allowed to communicate with a discharge pipe (not shown) of the refrigerating apparatus, via the discharge pressure chamber 41**.

In general, the suction pressure Ps changes less than the inner pressure of the crank chamber 5 (crank chamber pressure Pc). When the compressor is designed to allow the refrigerant gas with the suction pressure Ps to enter the inner chamber **42*b* as in the second embodiment, the pressure difference ΔP' between the intermediate pressure Pw and the suction pressure Ps, (ΔP'=Pw−Ps) becomes nearly constant. The crank chamber pressure Pc will not rise too much, making the flow rate q of the refrigerant gas through the restriction 51** stable.

Figure 7:
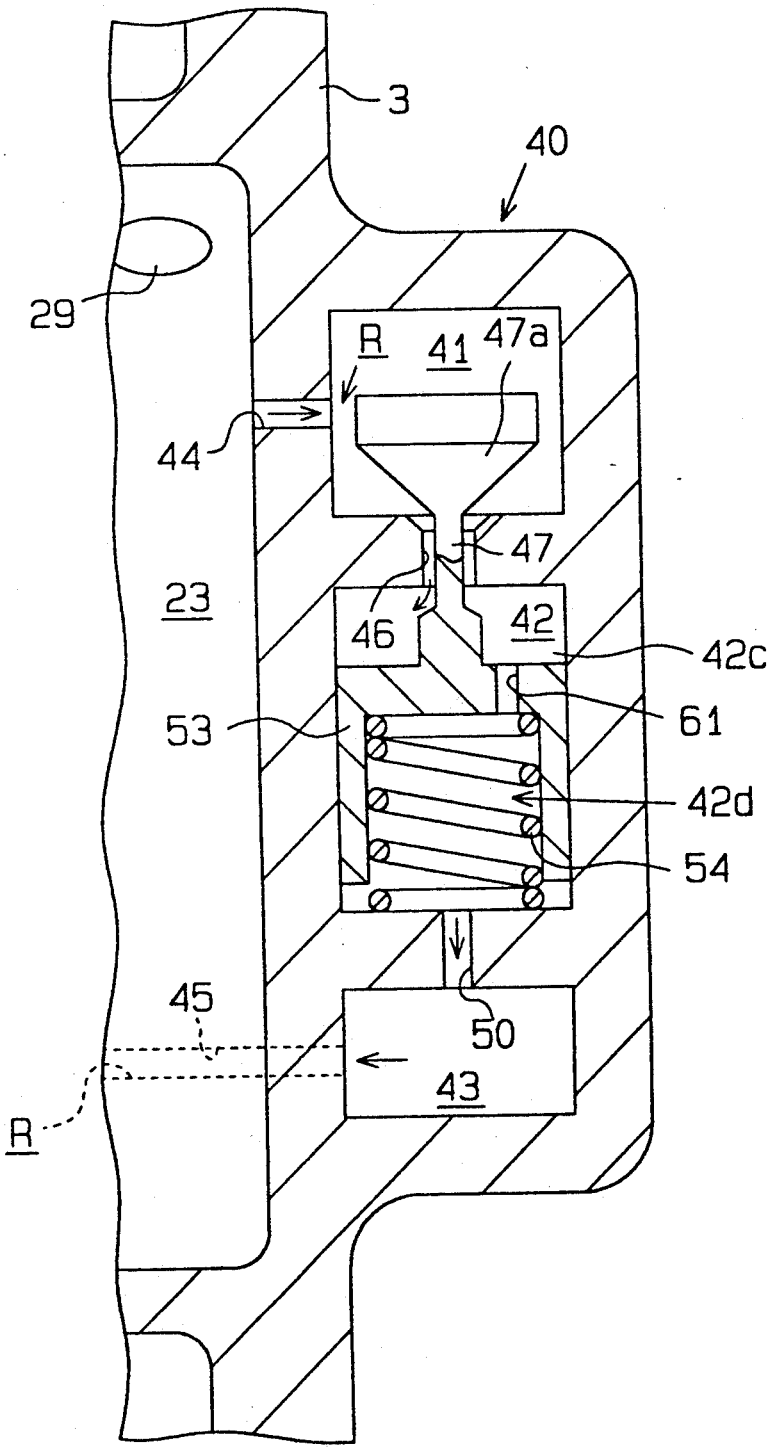
FIG. 7 is an enlarged cross-sectional view of a flow rate control valve mechanism for use in a compressor according to a third embodiment of the present invention.

A third embodiment of the present invention will now be described referring to FIGS. 7 and 8.

In the third embodiment, a cylindrical spool 53 with a cap is used for the aforementioned bellows 48, and the valve body 47 is coupled to that spool 53. Further, the spool 53 defines an outer chamber **42*c* and an inner chamber 42*d*. A coil spring 54 is provided in the inner chamber 42*d* for urging the spool 53 together with the valve body 47, toward the releasing position. In the top of the spool 53 is formed a restriction 61 that allows the outer chamber 42*c* to communicate with the inner chamber 42*d***.

According to the third embodiment, the position of the spool 53 is controlled as a function of the pressure difference ΔP between the intermediate pressure Pw in the outer chamber **42*c*, and the crank chamber pressure Pc in the inner chamber 42*d*. In other words, while the discharge pressure Pd rises from zero to the predetermined discharge pressure Pds, as shown in FIG. 8, after activation of the compressor, the spool 53** will not be displaced. The pressure difference ΔP thus rises linearly.

When the discharge pressure Pd reaches the predetermined discharge pressure Pds, the pressure difference ΔP reaches a maximum value. When the discharge pressure Pd further rises, and the intermediate pressure Pw increases accordingly, the valve body 47 shifts together with the spool 53 in a direction to reduce the opening of the valve hole 46, while compressing the spring 54. As a result, while the discharge pressure Pd rises beyond the predetermined discharge pressure Pds to the critical discharge pressure Pd0, the pressure difference ΔP decreases with the increase in the discharge pressure Pd.

In the third embodiment, the pressure difference applied to the spool 53 is expressed by the following equation, in which S1 denotes the entire sectional area of the valve hole 46, S2 denotes the pressure receiving area of the spool 53 on the outer chamber (**42*c*) side, and F is the elastic force of the spring 54**:

$$S1(Pd-Pw)+S2(Pw-Pc)=F$$

Rearranging the above equation yields the following equation for the pressure difference ΔP (=Pw−Pc) that acts on the spool 53.

$$(Pw-Pc)=\Delta P=F/S2-(Pd-Pw)S1/S2,$$

where Pw=(F+S1·Pc)/(S2−S1)−S1·Pd/(S2−S1).

Figure 8:
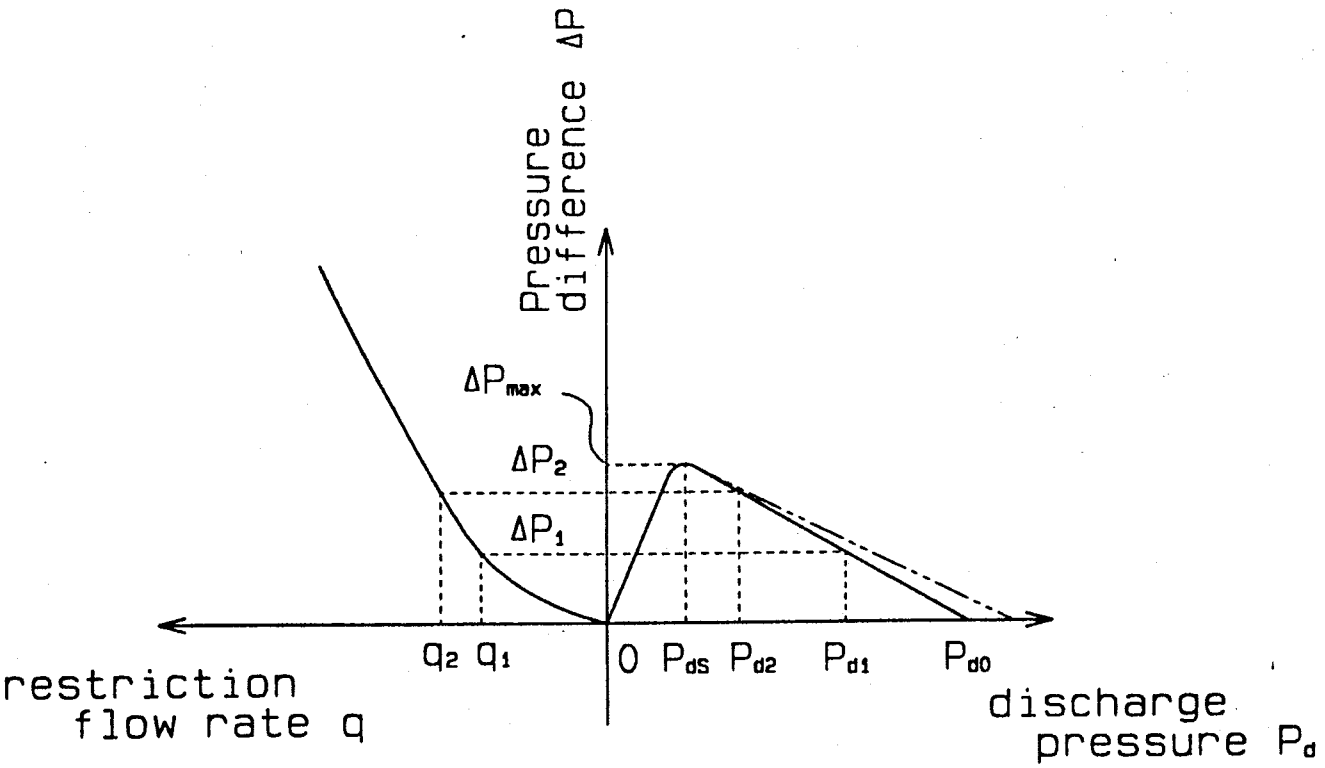
FIG. 8 illustrates graphs showing the relationship between the discharge pressure of the compressor according to the third embodiment and the volume of refrigerant supplied to the crank chamber, and the relationship between the flow rate at a restriction and the pressure difference in the inner and outer chambers of the bellows.
Figure 9A:
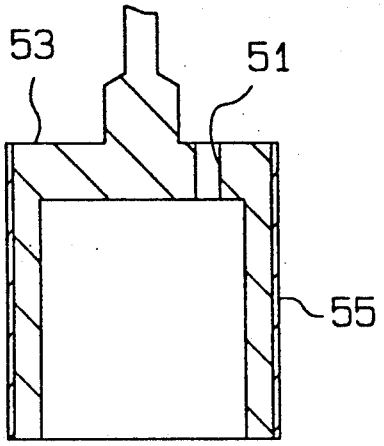
FIGS. 9(*a*) to 9(*d*) are partial cut-away cross-sectional views of compressors according to modifications of the present invention.
Figure 9B:
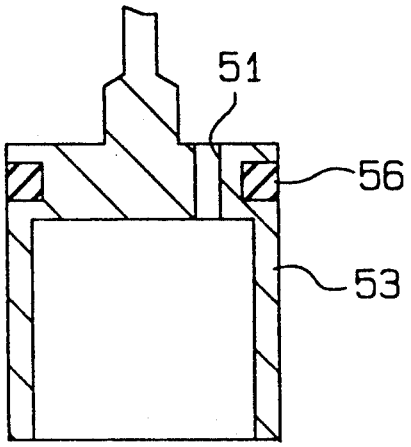
Figure 9C:
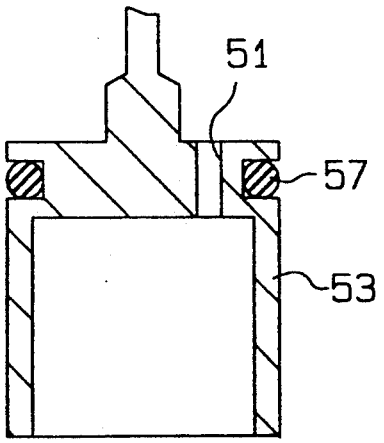
Figure 9D:
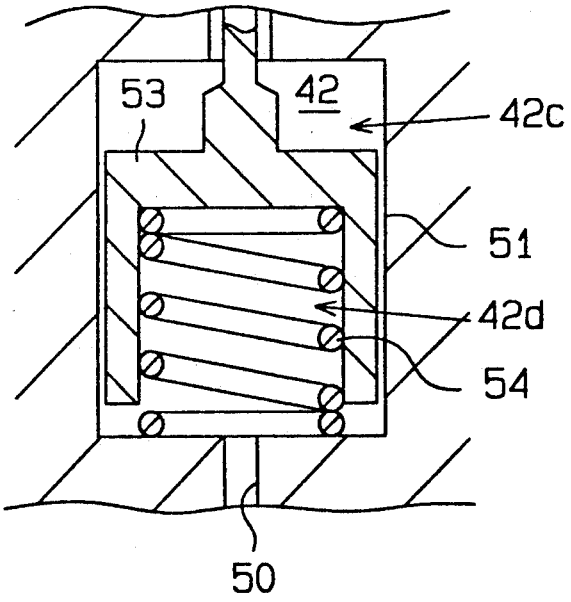

As the pressure receiving area S2 of the spool 53 on the outer chamber (42*c*) side increases, the inclination of a graph indicated by a broken line in FIG. 8 becomes lower.

Given that S3 denotes the sectional area of the restriction 61, the flow rate q of the refrigerant gas is calculated from the following equation:

$$q=S3\cdot\sqrt{[(Pw-Pc)\cdot Pc]}$$

Thus, the flow rate q of the passing refrigerant gas is expressed by a curve shown in FIG. 8.

In this embodiment, to suppress the blow-by gas from the side clearance between the outer surface of the spool 53 and the inner wall of the intermediate chamber 42, the side clearance is made narrower for effective action of the surface tension (viscosity) of a lubrication oil contained in the refrigerant gas. In addition, the sectional area S3 of the restriction 61 is set sufficiently larger than the leak area of the side clearance. Further, the spool 53 functions in a range where the pressure difference ΔP acting on the spool 53 is low.

Since the urging force of the spring 54 can be set more properly than the elastic force of the bellows 48 in the third embodiment, it would be relatively easy to set the timing at which the opening of the valve hole 46 starts becoming narrower by the valve body 47. This facilitates the general designing of the flow rate control valve mechanism 40, and contributes to cost reduction of the compressor. It should be noted that the other structures, functions and advantages of the third embodiment are similar to those of the first embodiment.

The present invention is not limited to the above-described embodiments, but may also be modified as follows.

(1) As shown in FIG. 9(*a*), the outer surface of the spool 53 may be coated with tetrafluoroethylene or like material to further narrow the side clearance. In this case, the lubricating action of tetrafluoroethylene smoothes the movement of the spool 53 to reduce the hysteresis of the flow rate of the refrigerant gas due to a change in the discharge pressure.

Alternatively, a ring 56 having a rectangular cross section may be fitted around the outer surface of the spool 53, as shown in FIG. 9(*b*), or an O-ring 56 may be fitted around outer surface of the spool 53, as shown in FIG. 9(*c*), to suppress the amount of the blow-by gas from the side clearance. Further, the restriction 61 of the spool 53 may be omitted while using the side clearance of the spool 53 itself as the restriction, as shown in FIG. 9(*d*).

Figure 10:
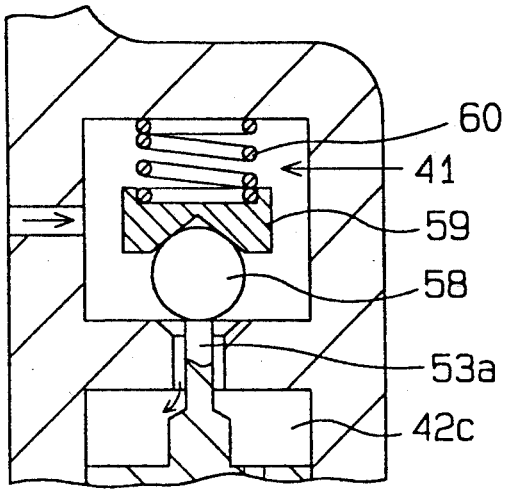
FIG. 10 is a cross-sectional view of a flow rate control valve mechanism for use in a compressor according to a further modification of this invention.
Figure 11:
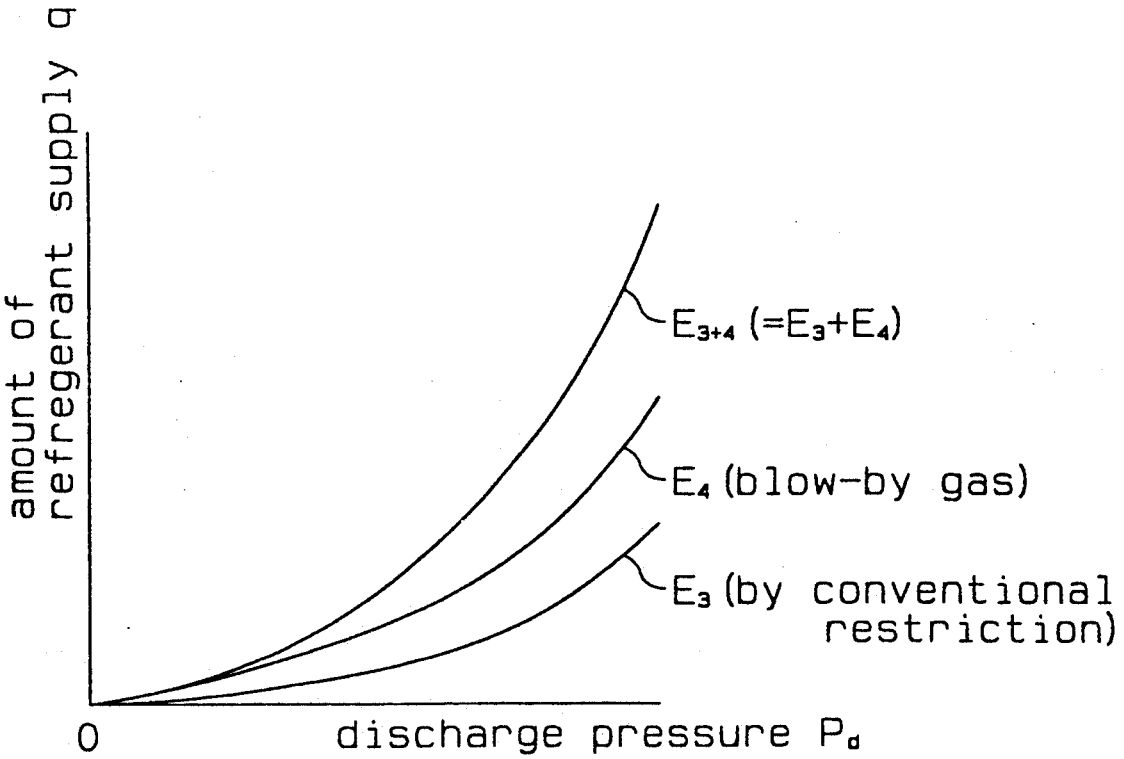
FIG. 11 is a graph showing the relationship between the discharge pressure in a conventional compressor and the volume of refrigerant supplied to the crank chamber.

(2) In the individual embodiments, the valve body 47 is fixed to the bellows 48 or the spool 53. As a modification to this structure, the valve body and the spool may be formed of separate members, as shown in FIG. 10. More specifically, the valve body 47 comprises a ball valve 58, a holder 59 and a spring 60, with the ball valve 58 pressed against the end face of a support rod 53*a* of the spool 53 through the holder 59 by the spring 60.

(3) As described above, the bellows 48 or the spool 53 is arranged below the valve body 47. As a modification to this structure, the vertical arrangement of the individual members 41, 43, 44, 46, 47 and 50 shown in FIG. 2 may be reversed. In this case, when the compressor is stopped, the valve body 47 is located under the force of gravity at a position which provides maximum opening.

The present example and embodiment are to be considered as illustrative and not restrictive, and the invention is not to be limited to the details given herein, but may be modified within the scope of the appended claims.

What is claimed is:

1. A variable displacement swash plate type compressor having a suction chamber, a discharge chamber and a crank chamber, the compressor comprising:

flow rate control valve means provided along a refrigerant supply passage for connecting the discharge chamber to the crank chamber, said flow rate control valve means including:

a discharge pressure chamber located on the discharge chamber side along the refrigerant supply passage;

an intermediate chamber located on the crank chamber side in the refrigerant supply passage;

a valve hole provided between said discharge pressure chamber and said intermediate chamber, to permit said discharge pressure chamber to communicate with said intermediate chamber;

pressure sensitive means provided in said intermediate chamber for separating said intermediate chamber into a first pressure sensitive chamber, which communicates with said discharge pressure chamber via said valve hole, and a second pressure sensitive chamber, which communicates with at least one of said crank chamber and said suction chamber, said pressure sensitive means being displaceable as a function of a pressure difference between said first and second pressure sensitive chambers;

a restriction provided along said refrigerant supply passage for permitting said first pressure sensitive chamber and said crank chamber to communicate with each other;

a valve body connected to said pressure sensitive means, and being displaceable in synchrony with the action of said pressure sensitive means, and being capable of regulating the opening of said valve hole according to that displacement; and a return member for returning said valve body and said pressure sensitive means to predetermined positions where said valve hole is opened by said valve body when pressure in said discharge chamber becomes almost zero.

2. The compressor according to claim 1, wherein said pressure sensitive means includes a bellows mechanism, which surves as said return member.

3. The compressor according to claim 1, wherein said pressure sensitive means includes a cylindrical spool having a top portion, and wherein said first and second pressure sensitive chambers are defined by said top portion and a wall of said spool.

4. The compressor according to claim 3, wherein said return member includes a spring for urging said spool toward said valve hole.

5. The compressor according to claim 4, wherein said spring is located in said wall of said spool.

6. The compressor according to claim 3, wherein a clearance is provided between an outer surface of said wall and an inner wall of said intermediate chamber;

wherein said top portion of said spool is provided with a restriction penetrating said top portion; and wherein said restriction has a section area that is larger than said clearance.

7. The compressor according to claim 6, wherein said outer surface of said wall is coated with tetrafluoroethylene.

8. The compressor according to claim 6, wherein a ring is secured to said outer surface of said wall, for reducing said clearance between said inner wall of said intermediate chamber and said outer surface of said wall of said spool.

9. The compressor according to claim 1, wherein said valve body is fixed to said pressure sensitive member.

10. The compressor according to claim 1, wherein said valve body includes a rod protruding from said pressure sensitive member and inserted into said valve hole, a ball valve capable of opening and closing said valve hole, and a spring for urging said ball valve in a direction for closing said valve hole.

* * * * *